United States Patent [19]

Schlunke et al.

[11] Patent Number: 4,932,827

[45] Date of Patent: Jun. 12, 1990

[54] APPARATUS FOR EXCHANGING ROLLS IN CALENDERS

[75] Inventors: Jürgen Schlunke, Krefeld; Dieter Junk, Kreuztal; Hartmut Wilke, Krefeld, all of Fed. Rep. of Germany

[73] Assignee: Kleinewefers GmbH, Krefeld, Fed. Rep. of Germany

[21] Appl. No.: 272,114

[22] Filed: Nov. 16, 1988

[30] Foreign Application Priority Data

Nov. 17, 1987 [DE] Fed. Rep. of Germany ..... 3738973

[51] Int. Cl.[5] ..... D21G 1/02; B66F 11/04; B21B 31/08

[52] U.S. Cl. ..... 414/280; 414/661; 414/911

[58] Field of Search ..... 414/277, 331, 280–282, 414/661, 911; 100/155 R; 242/79; 72/238, 239

[56] References Cited

U.S. PATENT DOCUMENTS

| | | | |
|---|---|---|---|
| 3,741,419 | 6/1973 | Bergerhoff et al. | 414/282 |
| 4,131,206 | 12/1978 | Kawada et al. | 242/79 X |
| 4,435,970 | 3/1984 | Sekiya | 72/239 |
| 4,625,637 | 12/1986 | Pav et al. | 100/47 |
| 4,678,390 | 7/1987 | Bonneton et al. | 414/280 X |
| 4,682,929 | 7/1987 | Kataoka | 242/79 X |
| 4,685,390 | 8/1987 | Pav et al. | 100/168 |

FOREIGN PATENT DOCUMENTS

| | | | |
|---|---|---|---|
| 109617 | 7/1982 | Japan | 72/238 |
| 77004 | 5/1985 | Japan | 414/280 |
| 433935 | 6/1974 | U.S.S.R. | 72/239 |
| 2338 | 4/1987 | World Int. Prop. O. | 414/280 |

OTHER PUBLICATIONS

"Taschenbuch für Maschinenbau", Dubbel, 1987, pp. T72, T73, and T76.

*Primary Examiner*—David A. Bucci
*Attorney, Agent, or Firm*—Peter K. Kontler

[57] ABSTRACT

An apparatus for exchanging elastic rolls in a supercalender has a platform which is movable up and down between the frame of a supercalender and a magazine for spare rolls. The platform supports two tracks with horizontally movable guides for two supports which can engage the end portions of an elastic roll from below before the guides and the supports are moved horizontally to transfer the roll from the supercalender, across the platform and into the magazine. In order to temporarily detach guide rolls which are installed in front of elastic rolls, the platform further supports two tracks for jaw-shaped supports for the end portions of a guide roll which is transferred into the apparatus and remains in the apparatus at a level above the tracks for the supports which transfer elastic rolls.

7 Claims, 4 Drawing Sheets

APPARATUS FOR EXCHANGING ROLLS IN CALENDERS

BACKGROUND OF THE INVENTION

The invention relates to improvements in apparatus for manipulating elongated objects, and more particularly to improvements in apparatus for manipulating rolls in calenders and like machines wherein groups of rolls are mounted in a frame and individual rolls must be exchanged from time to time for the purposes of inspection, repair or replacement. Still more particularly, the invention relates to improvements in apparatus of the type wherein a platform is provided with means for releasably supporting and moving rolls to and from prescribed positions for such rolls in the frames of supercalenders and like machines.

A supercalender comprises elastic rolls, hard rolls and guide rolls. It is often necessary to exchange damaged elastic rolls as well as to temporarily remove guide rolls which are used in such machines to establish a predetermined path for a running web of paper or other sheet-like material which is treated in the machine. Heretofore, a defective elastic roll was removed by a crane. Such mode of manipulating elastic rolls is not entirely satisfactory because a crane cannot be moved in front of a calender, so that it could engage a selected elastic roll, because the space in front of the elastic rolls is occupied by the aforementioned guide rolls. Furthermore, a crane cannot be used to directly engage the relatively short stubs at the axial ends of an elastic roll, mainly because of the presence of heating elements at the axial ends of hard rolls which are installed adjacent certain elastic rolls to define with the elastic rolls nips for the passage of a running web of paper or the like. Therefore, it is necessary to employ sleeves which must be slipped over the stubs at the axial ends of the elastic rolls in order to be engaged by a crane. Each such sleeve weighs several hundred kilograms so that a crane must be used to transport the sleeves to proper positions at the ends of a selected elastic roll which is to be removed from the frame of a supercalender. It is necessary to rely on workmen who guide the sleeves during that stage which involves introduction of stubs into the sleeves preparatory to removal of a roll from the frame of the supercalender. Such mode of exchanging rolls is time-consuming and necessitates the exertion of a pronounced effort by the attendants. The platform of a conventional apparatus is designed to move up and down along the supercalender so that the attendant or attendants can be moved to a desired level for proper manipulation of the sleeves as well as for the application or removal of screws, bolts or other threaded fasteners which are used to fix the bearings for the rolls to, or to separate such bearings from, the frame.

As a rule, a defective roll which is removed from the frame of a supercalender is transferred into a magazine. This involves a transport of the roll at a level above the platform. The attendants must leave the platform during such transfer of a roll for the reasons of safety. The same holds true during transfer of a fresh or repaired roll from the magazine into the supercalender.

Since the guide rolls are normally attached to the bearings for the adjacent elastic rolls, removal of an elastic roll from the frame of a supercalender further involves removal of the corresponding guide roll and temporary storage of the removed guide roll in the magazine. This necessitates the use of a relatively large magazine which must accommodate elastic rolls as well as guide rolls, and additional time is wasted for the transfer of guide rolls from the machine all the way into a magazine and back into the machine.

Commonly owned U.S. Pat. No. 4,685,390 granted Aug. 11, 1987 to Pav et al. discloses a calender with exchangeable rolls.

Certain types of conveyors for transport of commodities along horizontal paths are disclosed on pages T72, T73 and T76 of "Taschenbuch für Maschinenbau" by Dubbel (published 1987 by Springer-Verlag).

OBJECTS OF THE INVENTION

An object of the invention is to provide an apparatus which can exchange the rolls of a calender or a like machine within shorter intervals of time than a conventional apparatus.

Another object of the invention is to provide an apparatus which is constructed and assembled in such a way that it can be installed or moved in front of a calender and can readily remove selected rolls even if such rolls are located behind other rolls, such as behind guide rolls.

A further object of the invention is to provide an apparatus which is constructed and assembled in such a way that it need not transport detached guide rolls all the way to a magazine for spare rolls.

An additional object of the invention is to provide an apparatus which can dispense with sleeves for the stubs of elastic rolls and which can transport a roll toward or away from the frame of the machine without endangering the attendant or attendants.

Still another object of the invention is to provide an apparatus which can constitute a depository for temporary storage of detached rolls.

A further object of the invention is to provide a novel and improved method of exchanging elastic rolls and of temporarily removing guide rolls in a supercalender.

An additional object of the invention is to provide the apparatus with novel and improved supports for rolls and with novel and improved means for transporting such supports and the rolls thereon.

Another object of the invention is to provide the apparatus with novel and improved means for temporarily storing removed guide rolls of the type used in supercalenders and like machines.

A further object of the invention is to provide an automatic apparatus which is constructed and assembled in such a way that an attendant is merely required to manipulate the controls but need not actually lift, push, pull, turn and/or otherwise move any heavy and/or bulky parts of the apparatus.

Another object of the invention is to provide an apparatus which can deliver rolls to and/or accept rolls from conventional magazines or from specially designed magazines.

SUMMARY OF THE INVENTION

The invention is embodied in an apparatus for exchanging rolls in a calender, particularly for exchanging elastic rolls in a supercalender. The improved apparatus comprises a platform, means for moving the platform up and down along the rolls of a calender, substantially horizontal tracks on the platform, and supports movable along the tracks to move a selected roll to and from the calender.

The tracks preferably comprise first guides which are secured to the platform and second guides which are or can be telescoped into and are reciprocable in or along the first guides. The supports are provided on the second guides.

The platform has a first side which faces the calender and a second side which faces away from the calender. The second guides are movable beyond the respective first guides at both sides of the platform, and the supports are movably mounted on the second guides.

The platform includes first and second end portions, and the tracks are disposed between the two end portions of the platform. At least one of the end portions can be provided with facilities (e.g., with a cabin and a control panel) to accommodate at least one attendant.

The apparatus is preferably set up to transfer elastic rolls between a calender at one side and a magazine at the other side of the platform, and for moving guide rolls to and from the calender. The tracks of such apparatus include a pair of first tracks and a pair of second tracks, and the supports include a pair of first supports for elastic rolls and a pair of second supports for guide rolls. The first supports are reciprocable along and with portions of the first tracks, and the second supports are reciprocable along and/or with portions of the second tracks. The second supports can include or constitute jaws which are engageable with the end portions of guide rolls.

The just outlined apparatus can be used with advantage in conjunction with calenders wherein the end portions of elastic rolls are provided with bearings including first portions for the elastic rolls and second portions which are separable from the first portions and serve to carry guide rolls. The jaws of the second supports then serve to engage the second portions of such bearings and to move the second portions of the bearings and the respective guide roll away from the calender as soon as the second portions are separated from the first portions.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
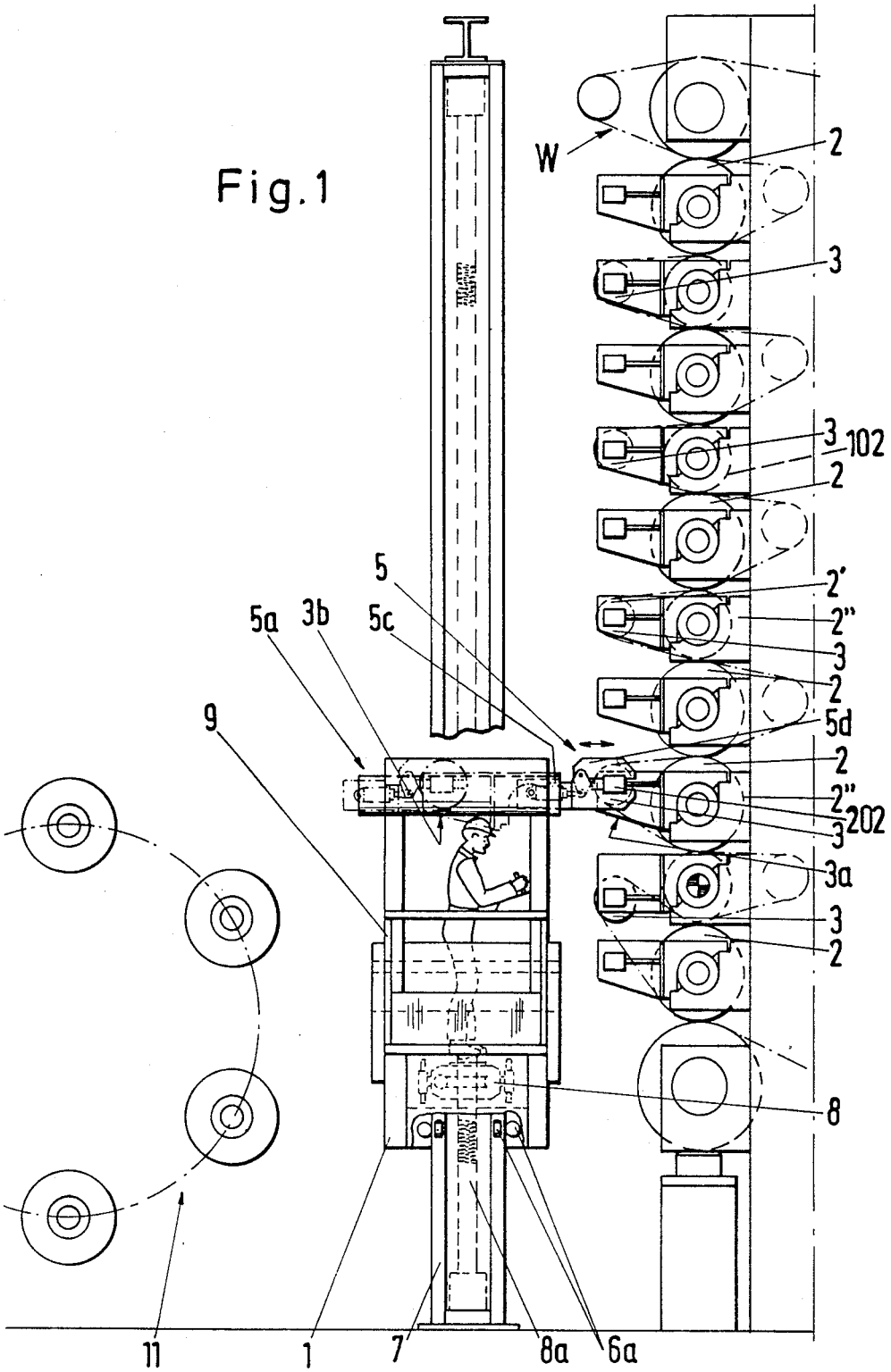
FIG. 1 is a side elevational view of an apparatus which embodies the invention and is installed between a supercalender and a magazine for spare or defective elastic rolls, the tracks and supports for the elastic rolls of the supercalender being omitted and one of the supports for guide rolls being shown in the inoperative or extended position.
Figure 2:
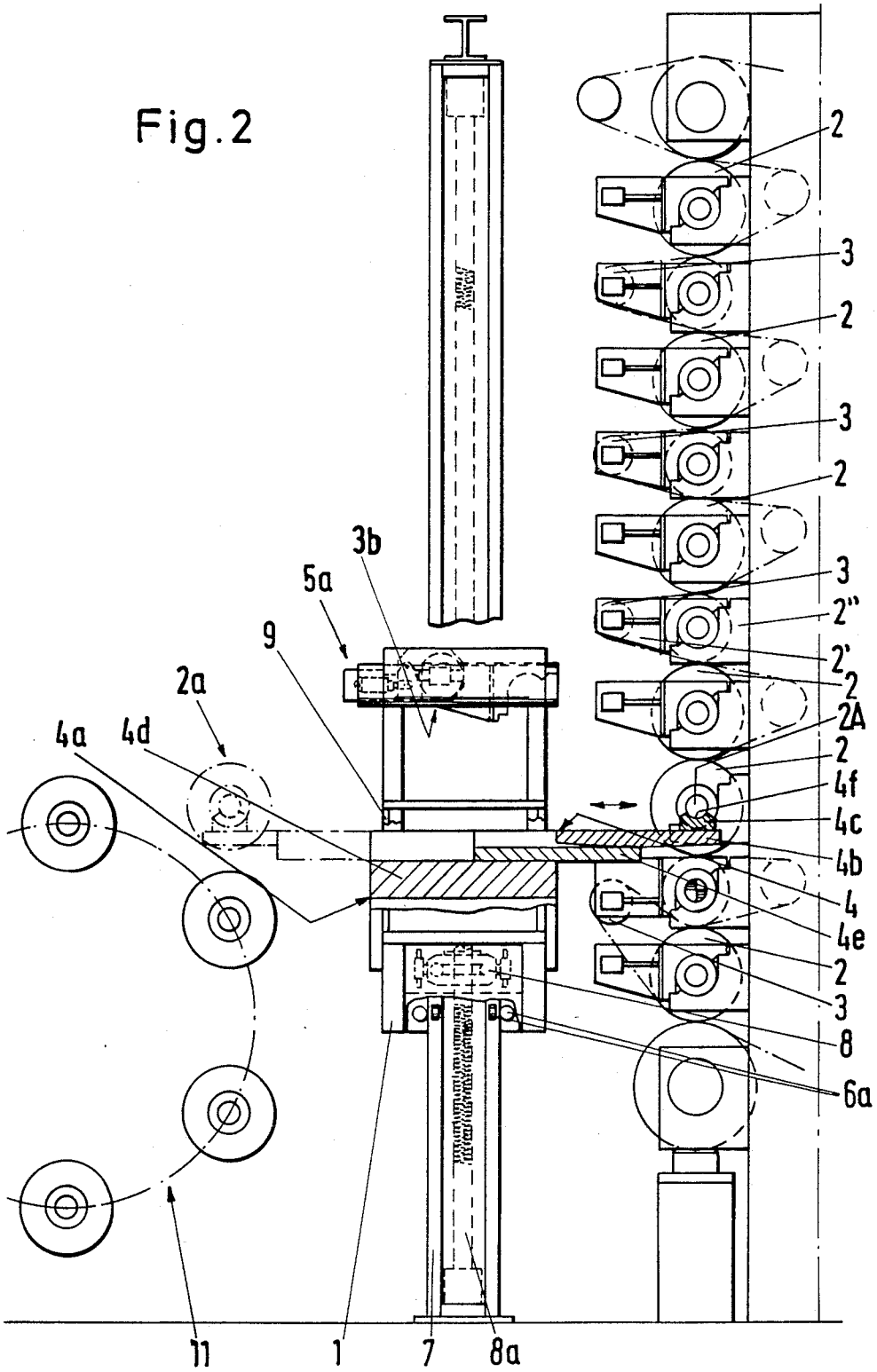
FIG. 2 is a similar side elevational view but showing one of the supports for the guide rolls in retracted position, one of the tracks and supports for an elastic roll being shown in a vertical sectional view as seen in the direction of arrows from the line II—II of FIG. 4.

The improved apparatus comprises an elongated horizontal platform 1 which is movable up and down in front of a supercalender (shown in the right-hand portions of FIGS. 1 and 2). The platform 1 has two end portions 1*a* and 1*b* at least one of which can be provided with facilities (e.g., a cabin) to accommodate or support one or more attendants. Such facilities further include a control panel 10 which is within reach of an attendant occupying the respective end portion (1*a*) of the platform 1.

The illustrated supercalender comprises an upright frame with two spaced-apart vertical sidewalls for a set of rolls which are mounted at different levels and include elastic rolls 2, hard rolls 102 which alternate with some or all of the elastic rolls 2, and guide rolls 3 in front of some or all of the rolls 2, 102. The guide rolls 3 serve to define a predetermined path for a web W of paper or other flexible material which is to be treated during travel through the nips of the rolls 2 and 102. The supercalender of FIGS. 1 and 2 can be similar to those disclosed in numerous United States and foreign patents of the assignee of the present application. Reference may be had, for example, to U.S. Pat. No. 4,625,637.

The platform 1 supports two substantially horizontal tracks 4 for supports 4*c*, and two substantially horizontal tracks 5 for supports 5*d*. The supports 4*c* are designed to carry the end portions or stubs 2A of elastic rolls 2, and the supports 5*d* constitute or include jaws which can engage and support bearings 2′ for the end portions 3A of guide rolls 3. A detached elastic roll 2 can be transferred from the frame of the supercalender into a magazine 11 (e.g., a magazine having a set of cradles which are indexible about a horizontal axis and each of which can support a roll 2), and a detached guide roll 3 can be temporarily supported by the platform 1. This obviates the need for the transport of a detached guide roll 3 all the way to the magazine 11 or to another depository which is more distant from the supercalender than the platform 1.

The paths along which the rolls 2 are transported between the supercalender and the magazine, and along which the guide rolls 3 are transported between the supercalender and the platform 1, are or can be substantially horizontal.

The bearings 2″ for the end portions or stubs 2A of the elastic rolls 2 constitute the rear portions of composite bearings which further include the bearings 2′ for the end portions or stubs 3A of the respective guide rolls 3. The rear bearings 2″ are separably connected to the respective front bearings 2′ by screws, bolts or analogous fasteners.

Each track 4 comprises a set 4*a* of guides which are telescoped into each other and include an outer guide 4d (see particularly FIGS. 4–6) in the platform 1, a first inner guide 4e (FIGS. 4–6) which is slidably telescoped into the respective outer guide 4d, and a second inner guide 4b (FIGS. 4–6) which is slidably telescoped into the inner first guide 4e. The supports 4c are longitudinally movably mounted on or in the respective second inner guides 4b and are normally located at either of the two ends of the respective second inner guides 4b. The guides 4d, 4e, 4b can constitute channels, tubes or pipes which are provided with longitudinally extending slots. In order to move an elastic roll 2 from the supercalender to the magazine 11, the first inner guides 4e are moved to the solid-line positions of FIGS. 3–5, the second inner guides 4b are moved to the solid-line positions of FIGS. 3–5, and the supports 4c are also moved to the solid-line positions of FIGS. 3–5 to be located beneath the end portions 2A of the respective elastic roll 2. The first inner guides 4e are then moved from the right-hand side to the left-hand side of the platform 1 to occupy the phantom-line positions of FIG. 3, the second inner guides 4b are also moved to the other side of the platform 1 to the phantom-line positions of FIG. 3, and the downwardly extending followers 4g (FIG. 5) of the supports 4c are caused to transport the supports 4c and hence the elastic roll 2 the phantom-line positions of FIG. 3 in which the roll (in the position 2a) is ready to be lifted off the supports 4c in response to counterclockwise indexing of the magazine 11 (as seen in FIG. 1 or 2) and/or in response to downward movement of the platform 1. It goes without saying that the cradles of the magazine 11 are first indexed to positions in which an empty cradle of the magazine is located at a level beneath the elastic roll 2 which is shown (at 2a) in FIG. 2 by phantom lines at the left-hand side of the platform 1. The means for moving the inner guides 4b, 4e relative to each other and relative to the outer guide 4d, as well as for moving the supports 4c relative to the guides 4b comprises endless chain or belt conveyors but such moving means could also comprise rack and pinion drives, hydraulic or pneumatic motors or any other suitable means which can reciprocate the inner guides 4e, 4b and the support 4c at one side of the supercalender in synchronism with the inner guides 4e, 4b and support 4c at the other end of the supercalender. Each first inner guide 4e extends longitudinally into the respective outer guide 4d, each second inner guide 4b extends longitudinally into the respective first inner guide 4e, and the follower 4g of each support 4c extends downwardly into the longitudinal slot of the respective second inner guide 4b. Other types of guides can be used with equal or similar advantage, as long as they enable the supports 4c to transfer the end portions 2A of an elastic roll 2 between the solid-line and phantom-line positions of FIG. 3.

Figure 3:
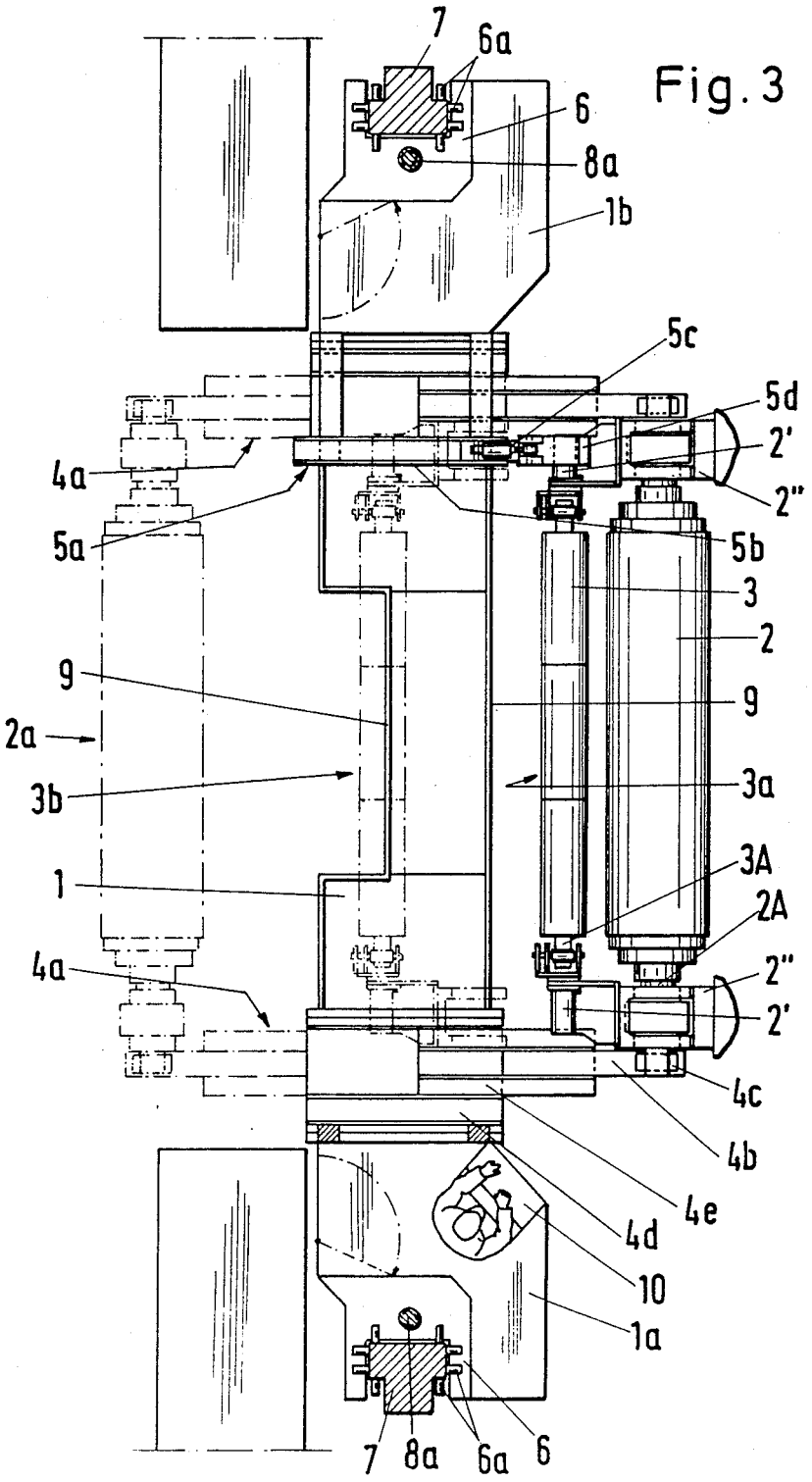
FIG. 3 is a horizontal sectional view of the apparatus, the section being taken at a level above the platform and the supports for an elastic roll being shown in operative positions, one of the tracks and one of the supports for guide rolls being omitted and the other track and support for guide rolls being shown in the operative position.

Each of the tracks 5 (only one of these tracks is shown in FIG. 3) comprises a first guide 5b which is installed in a portion 5a of the platform 1 and supports a reciprocable fluid-operated (preferably hydraulic) opening and closing device (second guide) 5c for the respective support or jaw 5d. The guide 5b is a channel, tube or pipe and the device 5c is slidably telescoped into the respective guide 5b. The supports or jaws 5d can grip the respective bearings 2' for the end portions 3A of the selected guide roll 3, and these jaws are slidable with the respective devices 5c along the respective guides 5b between the solid-line and phantom-line positions of FIG. 3 (see also FIGS. 1 and 2) to transfer a guide roll 3 between the supercalender and a position on top of the platform 1, i.e., at a level above the tracks 4 for the supports 4c which serve to transfer elastic rolls 2.

Figure 4:
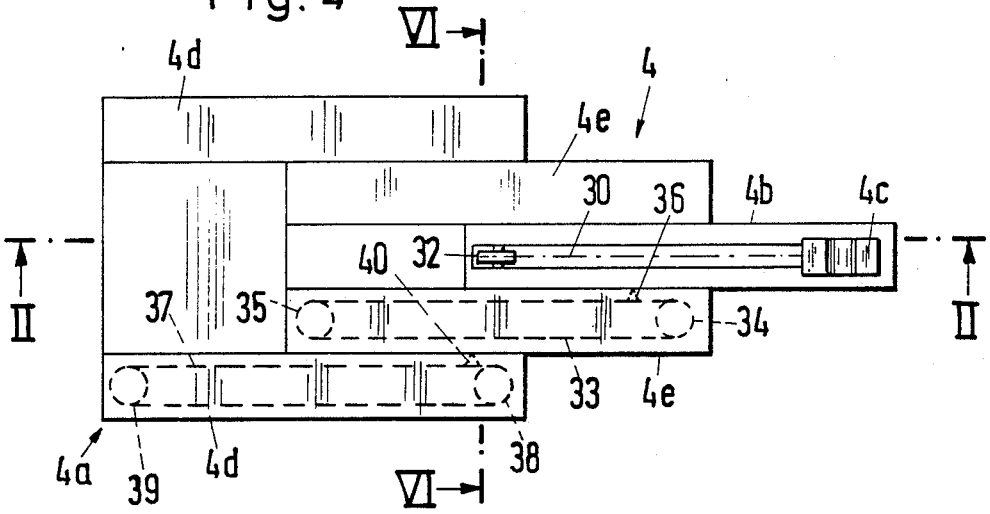
FIG. 4 is an enlarged plan view of one of the tracks for elastic rolls, with the movable guides and the support in extended positions corresponding to those shown in FIG. 3 by solid lines.
Figure 5:
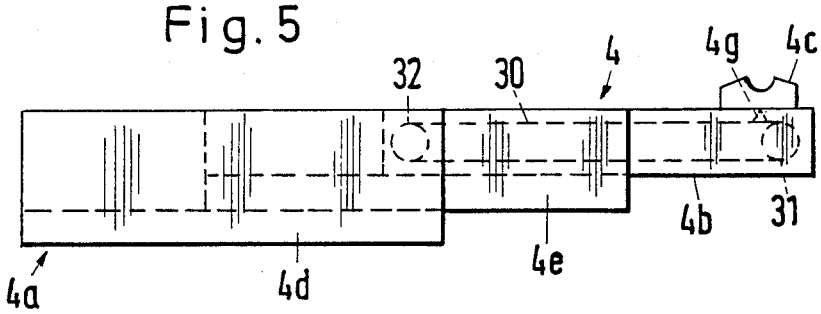
FIG. 5 is a side elevational view of the track which is shown in FIG. 4.
Figure 6:
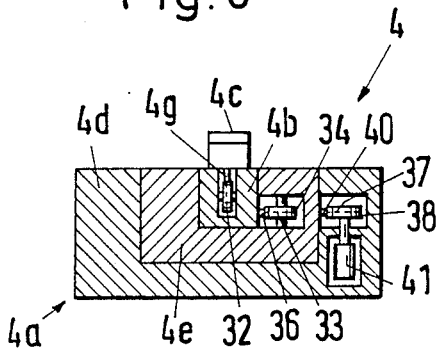
FIG. 6 is a transverse vertical sectional view as seen in the direction of arrows from the line VI—VI of FIG. 4.

It is presently preferred to employ fluid-operated (particularly hydraulic) means or chain drives to move the reciprocable guides 4b, 4e of the tracks 4 relative to each other and relative to the corresponding outer guides 4d, to move the devices 5c relative to the guides 5b, as well as to move the supports 4c for the elastic rolls 2 relative to the respective guides 4b. It is also possible to employ chain transmissions. The prime movers of such moving means can be started and arrested and their speeds regulated from the control panel 10 in the cabin on the end portion 1a of the platform 1. The supports 4c for the end portions 2A of the rolls 2 are operated in synchronism, the same as the supports (jaws) 5d for the end portions 3A of the rolls 3. FIGS. 4–6 show a transmission including an endless chain 30 with sprocket wheels 31, 32 as a means for moving the follower 4g along the second inner guide 4b; a transmission including an endless chain 33 and sprocket wheels 34, 35 as a means for moving the follower 36 of the second inner guide 4b relative to the first inner guide 4e, and a transmission including an endless chain 37, sprocket wheels 38, 39, a follower 40 and electric motor 41 as a means for moving the first inner guide 4e relative to the outer guide 4d. The motor 41 receives signals from the control panel 10, the same as the motors (not shown) for the endless chains 30 and 33. The drive means (not shown) for moving the devices 5c relative to the corresponding guides and the control valves (not shown) for the devices 5c also receive signals from the control panel 10.

The platform 1 has two carriages 6 which are movable up and down along upright columns 7 and carry a plurality of roller followers 6a which can roll along the adjacent surfaces of the respective columns. The roller followers 6a can be replaced with linear guides. The means for moving the carriages 6 and the platform 1 up and down comprises rotary feed screws 8a which mesh with nuts of the carriages 6 and are rotatable by motors (not shown) through the medium of suitable planetary transmissions 8. Such moving means can be replaced with chain transmissions, cable transmissions or hydraulic cylinder and piston units.

The platform 1 is provided with safety railings 9 which can be pivoted or otherwise moved out of the way prior to transfer of a roll 2 from the magazine 11 to the supercalender or vice versa.

The operation is as follows:

If an attendant desires to exchange an elastic roll 2 which is installed behind a guide roll 3, the moving means including the feed screws 8a and planetaries 8 is operated to move the platform 1 to the level of the corresponding guide roll 3. The bearings 2' are provided with polygonal (particularly square or rectangular) mounting studs 202. Such studs are engaged by the respective supports or jaws 5d (see FIG. 1) before the screws which connect the bearings 2' to the corresponding bearings 2'' are removed or loosened. The devices 5d and the corresponding supports or jaws 5c are then retracted to the positions of FIG. 2, together with the guide roll 3 and bearings 2', before the platform 1 is caused to move upwardly so as to advance the tracks 4 to the level of the now accessible elastic roll 2. This completes the movement of the guide roll 3 from the position 3a of FIG. 1 to the position 3b of FIG. 2. The reciprocable guides 4e, 4b of the tracks 4 remain retracted in the corresponding outer guides 4d during the just described transfer of a guide roll 3 from the position 3a to the position 3b.

The inner guides 4e, 4b of the tracks 4 are then moved to extended positions toward the supercalender so that the supports 4c are located beneath the respective stubs 2A. Slight additional lifting of the platform 1 results in engagement of the supports 4c with the respective stubs 2A (see FIG. 2). The upper sides of the supports 4c have relatively shallow concave sockets 4f for portions of the adjacent stubs 2A. The safety railings 9 are pivoted or otherwise moved to a level beneath the upper side of the platform 1 before the supports 4c are moved to the left (as seen in FIGS. 2 and 3) so as to withdraw the elastic roll 2 from the frame of the supercalender. The extracted roll 2 is moved to the left, beneath the guide roll 3 (in the position 3b) and toward the magazine 11 to assume the phantom-line position 2a of FIG. 2. The cradles of the magazine 11 are indexed beforehand or during transfer of the roll 2 from the supercalender so that an empty cradle assumes an optimum position beneath the roll 2 in the position 2a. The next indexing movement of the cradles of the magazine 11 in a counterclockwise direction results in removal of the roll 2 from the supports 4c. Alternatively, the platform 1 can be lowered to deposit the roll 2 in an empty cradle.

The next operation involves removal of a fresh or repaired elastic roll 2 from the magazine 11 and the transfer of such roll into the supercalender to take the place of the previously removed roll 2. Such operation is carried out by reversing the aforediscussed sequence of steps, i.e., the supports 4c are moved to the right in order to insert the fresh roll 2 into the frame of the supercalender, the supports 4c are then lowered to move their sockets 4f beneath the respective stubs 2A, and the supports 4c are then retracted so that the platform 1 is free to move up and down along the columns 7. Such movement of the platform 1 is necessary in order to lower the guide roll 3 (in the position 3b) to the level of the freshly installed elastic roll 2 before the guide roll 3 is moved from the position 3b to the position 3a and the bearings 2' are attached to the bearings 2'' for the freshly installed roll 2.

If the operator wishes to replace an elastic roll 2 which is not disposed behind a guide roll 3, the first step merely involves a transfer of bearings 2' from the positions 3a to the positions 3b before the movable guides 4e, 4b of the tracks 4 are extended to move the supports 4c beneath the respective stubs 2A of the elastic roll 2 which is about to be transferred into the magazine 11.

One or more persons can occupy the end portion 1a or 1b of the platform 1 during transfer of a roll 3 from the position 3a to the position 3b (or vice versa) as well as during transfer of an elastic roll 2 between the supercalender and the magazine 11.

When the improved apparatus is not used for exchange, removal or installation of rolls 2 and/or 3, the platform 1 can be moved to any desired level in order to enable the attendants to thread the leader of a fresh web W into the path which is defined by the guide rolls 3 and the nips of the rolls 2, 102. At such time, the barrier 9 is maintained in the raised or operative position to enhance the safety of the occupant or occupants of the platform 1.

The feature that the guides 4e, 4b of the tracks 4 and the devices 5c of the tracks 5 are held against any other but substantially horizontal reciprocatory movement relative to the platform 1 contributes to safety of the apparatus. This also applies for the movability of supports 4c and jaws 5d relative to the guides (4b, 5b) of the respective tracks.

Another important advantage of the improved apparatus is that one can dispense with a crane as well as that the platform 1 can be put to use when the apparatus is not needed for an exchange of rolls 2.

Since the tracks 5 for guide rolls 3 are disposed at a level other than the level of the tracks 4 for elastic rolls 2, the guide rolls 3 can be stored in the apparatus during transfer of an elastic roll 2 between the supercalender and the magazine 11. This results in substantial savings in time which is needed to complete the replacement of an elastic roll 2 and which further involves temporary removal of the corresponding guide roll 3 from and reinsertion of such guide roll into the supercalender. Moreover, the entire roll exchanging operation can be automated so that the attendant or attendants need not perform any heavy manual work but merely operate the knobs, levers, pushbuttons and/or other elements on the control panel 10. Still further, the improved apparatus is much safer than heretofore known apparatus which employ or constitute cranes because the attendants need not move even close to heavy suspended objects such as the aforediscussed sleeves of conventional apparatus and/or guide rolls and/or elastic rolls which are on their way from the supercalender toward a magazine or vice versa.

The jaw-shaped supports 5d for the studs 202 of the bearings 2' can be replaced with supports which are similar to or identical with supports 4c for the stubs 2A of elastic rolls 2. Jaw-shaped supports 5d are preferred at this time because they render it possible to complete the transfer of relatively heavy guide rolls 3 between the positions 3a and 3b within very short intervals of time without risking any movements of guide rolls relative to the supports or jaws 5d.

The bearings 2' can be designed to partially surround the stubs 2A of the adjacent elastic rolls 2 when they are properly secured to the corresponding bearings 2''. The ability of supports or jaws 5d to remove the detached bearings 2' with a guide roll 3 ensures that the end portions or stubs 2A of an elastic roll 2 are accessible to the supports 4c as soon as the transfer of the corresponding guide roll 3 to the position 3b is completed. Moreover, such design of the bearings for the elastic rolls 2 and for the corresponding guide rolls 3 renders it possible to leave the end portions 3A of the guide rolls 3 in the respective bearings 2' during transfer of guide rolls between the positions 3a and 3b.

A magazine which can be used for temporary storage of elastic calender rolls is disclosed in commonly owned copending patent application Ser. No. 272,096 filed Nov. 16, 1988 by Schlunke et al. for "Magazine for calender rolls".

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for transferring elastic rolls between a calender and a magazine and for moving guide rolls to and from the calender, comprising a platform; means for moving said platform up and down along the rolls of a calender; a pair of substantially horizontal first tracks and a pair of substantially horizontal second tracks provided on said platform; and supports movable along said first and second tracks to move a selected roll to and from the calender, said supports including a pair of first supports for elastic rolls and a pair of second supports for guide rolls, said first supports being reciprocable along said first tracks and said second supports being reciprocable along said second tracks.

2. The apparatus of claim 1, wherein said first and second tracks comprise first guides secured to said platform and second guides telescoped into and reciprocable in said first guides, said supports being provided on said second guides.

3. The apparatus of claim 2, wherein said platform has a first side facing the calender and a second side facing away from the calender, said second guides being movable beyond the respective first guides at both sides of said platform and said first and second supports being mounted on said second guides.

4. The apparatus of claim 1, wherein said first and second supports include jaws which are engageable with the end portions of rolls.

5. The apparatus of claim 4 for exchanging guide rolls in a supercalender, wherein said jaws are movable along said guides into and from engagement with the end portions of guide rolls.

6. The apparatus of claim 1 for transferring elastic rolls of the type having end portions provided with composite bearings including first bearings for elastic rolls and second bearings separable from the first bearings and arranged to carry guide rolls, said second supports including jaws engageable with the second bearings for the selected guide roll.

7. The apparatus of claim 1, wherein said platform includes a first and a second end portion and said first and second tracks are disposed between said end portions, at least one of said end portions having facilities to accommodate an operator.

* * * * *